United States Patent [19]

Metcalf

[11] Patent Number: 5,067,604

[45] Date of Patent: Nov. 26, 1991

[54] SELF TEACHING COIN DISCRIMINATOR

[75] Inventor: Stanley M. Metcalf, Western Springs, Ill.

[73] Assignee: Bally Manufacturing Corporation, Chicago, Ill.

[21] Appl. No.: 269,526

[22] Filed: Nov. 14, 1988

[51] Int. Cl.[5] ..... G07D 5/08

[52] U.S. Cl. ..... 194/203; 194/317; 194/318

[58] Field of Search ..... 194/317, 318, 319, 203, 194/344

[56] References Cited

U.S. PATENT DOCUMENTS

| | | | |
|---|---|---|---|
| 3,169,626 | 2/1965 | Miyagawa et al. | 194/317 |
| 3,373,856 | 3/1968 | Kusters et al. | 194/318 |
| 3,926,291 | 12/1975 | Burke et al. . | |
| 3,952,851 | 4/1976 | Fougere et al. | 194/317 |
| 3,998,309 | 12/1976 | Mandas et al. | 194/203 |
| 4,184,366 | 1/1980 | Butler | 194/317 X |
| 4,334,604 | 6/1982 | Davies . | |
| 4,354,587 | 10/1982 | Davies . | |
| 4,359,148 | 11/1982 | Davies . | |
| 4,437,478 | 3/1984 | Abe . | |
| 4,437,558 | 3/1984 | Nicholson et al. . | |
| 4,469,213 | 9/1984 | Nicholson et al. . | |
| 4,556,140 | 12/1985 | Okada | 194/334 X |
| 4,557,365 | 12/1985 | Stackhouse | 194/344 X |
| 4,574,935 | 3/1986 | Partridge . | |
| 4,601,380 | 7/1986 | Dean et al. | 194/318 |
| 4,660,705 | 4/1987 | Kai et al. | 194/318 |
| 4,662,501 | 5/1987 | Partridge . | |
| 4,696,385 | 9/1987 | Davies | 194/319 |
| 4,705,154 | 11/1987 | Masho et al. | 194/318 X |
| 4,749,074 | 6/1988 | Ueki et al. | 194/317 |
| 4,838,405 | 6/1989 | Kimoto | 194/318 |

FOREIGN PATENT DOCUMENTS

| | | | |
|---|---|---|---|
| 3445779 | 6/1986 | Fed. Rep. of Germany . | |
| 2199978 | 7/1988 | United Kingdom | 194/317 |
| 86/06246 | 11/1986 | World Int. Prop. O. . | |

*Primary Examiner*—F. J. Bartuska
*Attorney, Agent, or Firm*—Jenner & Block

[57] ABSTRACT

By combining a number of different types of coin sensors including a reflective sensor, a capacitive sensor and inductive sensors together with a logic circuit it is possible to provide for highly accurate and flexible discrimination between authorized and unauthorized coins or tokens. Fexibility is further enhanced by a self teaching feature where a microprocessor is used to iteratively adjust upper and lower value limits in the sensor circuits in response to the insertion of a limited number of sample coins.

11 Claims, 4 Drawing Sheets

FIG. 8
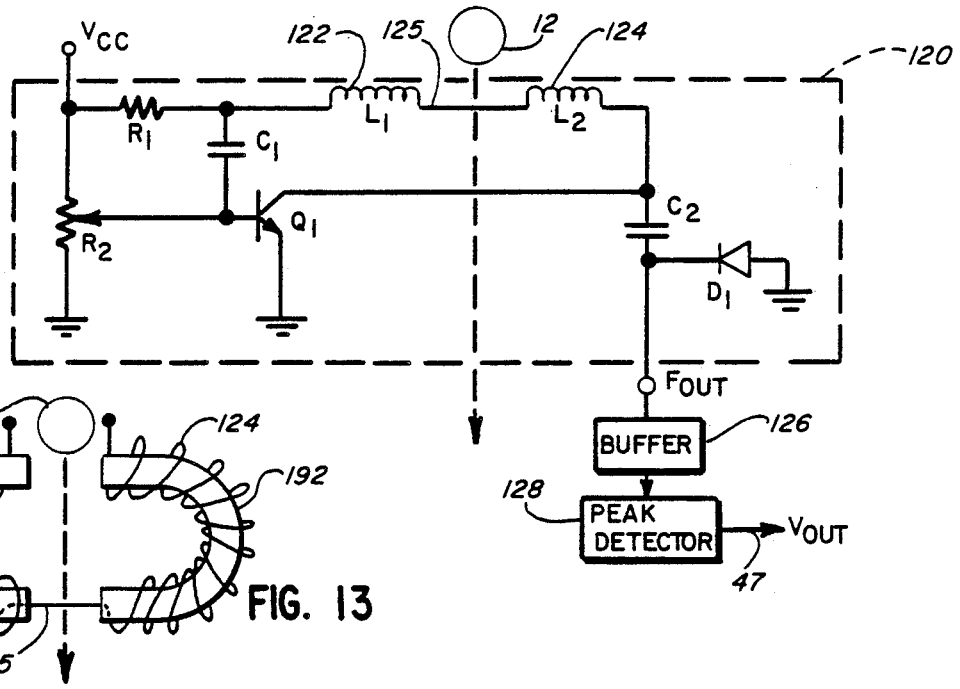
FIG. 13
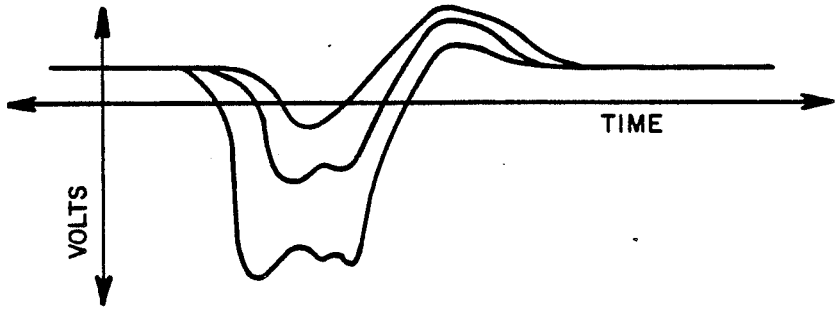
FIG. 9
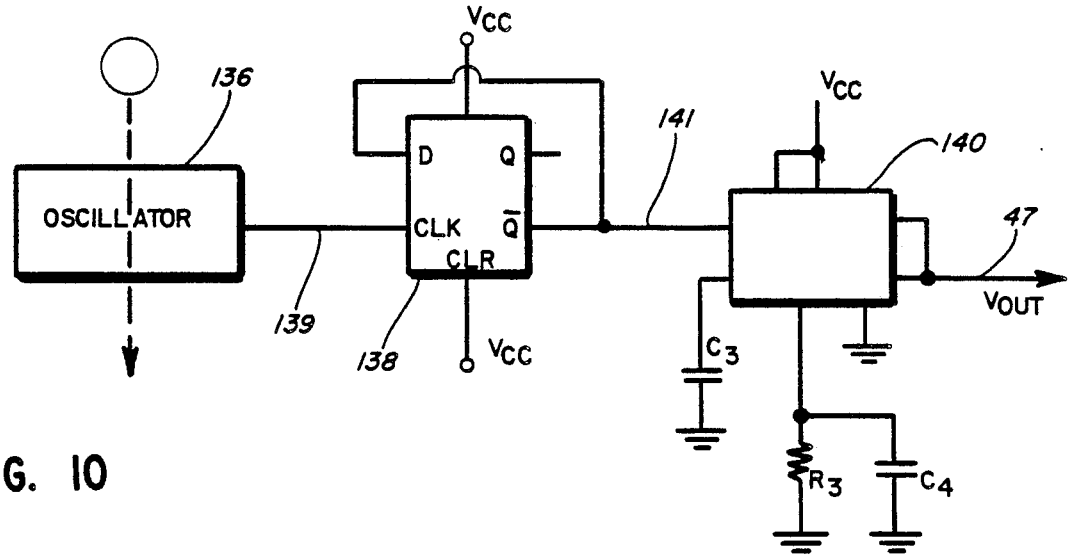
FIG. 10

SELF TEACHING COIN DISCRIMINATOR

TECHNICAL FIELD

The invention relates to the field of coin operated machines, and in particular to the methods of discriminating between real coins or tokens and unauthorized coins, tokens or other objects.

BACKGROUND OF THE INVENTION

Many types of gaming and vending machines are activated by the insertion of one or more coins or tokens. Not infrequently, users of these machines will unlawfully insert coins or tokens of a lesser value or even slugs in order to avoid spending genuine coins or tokens. Consequently, the machines are typically equipped with devices which can discriminate between authorized coins and other objects. Such devices generally employ electrical or mechanical sensors which measure the size, weight or magnetic properties of the inserted object. These measurements are the basis upon which the object is either accepted as a valid coin or rejected as a counterfeit.

However, existing coin discriminators, such as those described in the PCT patent application W086/06246 and U.S. Pat. Nos. 3,926,291, 3,998,309, 4,334,604, 4,354,587, 4,359,148, 4,437,478, 4,437,558, 4,469,213, 4,556,140 and 4,662,501, suffer from a number of deficiencies. First, the existing devices tend to improperly accept unauthorized objects because they do not subject the inserted objects to sufficiently rigorous testing. Second, the devices which are most reliable tend to employ costly and complex sensor means. Third, most devices are designed to accept only one type of coin or token and consequently, they may require extensive adjustment or modification when used in a casino which issues a unique type of token or when it is desired to change the coins to be accepted by the machine. Fourth, those devices which can be reprogrammed to accept different coins, for example the system described in U.S. Pat. No. 4,556,140, employ costly and complex technologies and require that the operator insert an inconveniently large number of sample coins to program the device. Fifth, some devices require physical contact between the sensor and the coin, which can cause excessive wear of the sensor.

SUMMARY OF THE INVENTION

It is therefore an object of the invention to provide a discriminating method and apparatus which can reliably distinguish between real and unauthorized coins or tokens. This is achieved by a combination of capacitive, inductive and reflective sensors where the output of each sensor is compared to predetermined reference values. If even one sensor output does not fall within a predetermined set of reference values, the inserted object is rejected. By employing a combination of sensor types, the device is able to distinguish between real and unauthorized coins with a remarkably high level of reliability.

An additional object of the invention is to provide a sensor means which can be programmed to accept only those coins which exhibit predetermined inherent properties. This is achieved by employing a detector circuit which is operatively connected to a pair of analog voltage comparators. When a coin passes within close proximity to the detector circuit, the circuit will generate an output voltage which is a function of a particular inherent property of the coin. The pair of analog comparators is then used to determine whether the detector circuit voltage generated by the coin falls within a predetermined range as defined by an upper and a lower reference voltage. These reference voltages are generated by digital-to-analog convertors which are operatively connected to digital storage elements, and each reference voltage can be set to any desired value by placing the appropriate binary number in each digital storage element. In this manner, the aforementioned range can be programmed, thereby resulting in the acceptance of only those coins with properties which cause the output voltage of the detector circuit to fall within that range.

An additional object of the invention is to provide a method for convenient programming of the aforementioned programmable sensor. This programming is achieved by employing a microprocessor which is operatively connected to the programmable sensor's digital storage elements. The microprocessor utilizes an iterative procedure to arrive at the appropriate reference values. This procedure requires the user to insert eight sample coins of the type to be henceforth accepted by the programmable sensor. For the first coin, the microprocessor places arbitrary values in the sensor's digital storage elements. For each of the remaining seven coins, the microprocessor, through an iterative procedure, raises and lowers the values contained in the digital storage means, thereby adjusting the range of acceptable detector circuit voltage output to more closely match the voltage outputs actually generated by each successive sample coin.

An additional object of the invention is to provide a discriminating method and apparatus which can accommodate coins of varying diameters. This is accomplished by employing a coin-path conduit of adjustable width in combination with coin sensors which do not completely encompass the conduit.

An additional object of the invention is to provide a capacitive detector circuit which is capable of measuring the thickness and diameter of a coin that is both reliable and inexpensive, and which requires no physical contact with the coin. This is accomplished by placing two electrically conductive metal plates on opposing sides of the coin's path of transport. As the coin passes between the plates, it causes a change in capacitance resulting in a signal which is primarily a function of the coin's diameter and thickness.

An additional object of the invention is to provide an inductive detector circuit capable of measuring the magnetic properties of a coin or similar object that is reliable and inexpensive and which does not require physical contact with the coin. This is accomplished by placing a portion of an oscillating circuit along the coin's path of transport. This portion includes two inductive coils wired in series around a U-shaped ferrite core. As the coin moves in close proximity to the ferrite core, it causes a change in the amplitude and frequency of the signal produced by the oscillator circuit. This change in amplitude and frequency is a function of the coin's intrinsic magnetic characteristics.

An additional object of the invention is to provide a reflective detector circuit which is capable of measuring the surface reflectivity of a coin and does not require physical contact with the coin. This is accomplished by projecting a beam of light at the moving coin. The coin's reflectivity is measured by a photosensor, which produces a voltage proportional to the intensity of light reflected from the surface of the coin.

An additional object of the invention is to provide a sensing circuit which can detect when a coin or similar object is traveling through the coin discriminating apparatus in the wrong direction. This is achieved by employing a logic circuit operatively connected to a pair of photosensors which are positioned a short distance apart along the coin's path of travel. The sensors are triggered by the presence of an opaque object and are positioned along the coin's path of travel so that the sequence in which they are triggered depends on the direction in which the coin is traveling. The logic circuit generates an error or "tilt" signal if the triggering sequence indicates that the coin is traveling in the wrong direction.

BRIEF DESCRIPTION OF THE DRAWINGS

FIG. 8 is a schematic diagram of an inductive amplitude-shift-detector circuit that can be used as one of the detector circuits in the programmable sensor circuit of FIG. 4;

FIG. 9 is a graph of various voltage outputs of the peak detector portion of the circuit of FIG. 8;

FIG. 10 is a schematic diagram of an inductive frequency-shift detector circuit that can be used for one of the detector circuits in the programmable sensor circuit of FIG. 4;

FIG. 13 is a plan view of inductive elements that can be used in the detecting circuits of FIGS. 8 and 10.

DETAILED DESCRIPTION OF THE INVENTION

Figure 1:
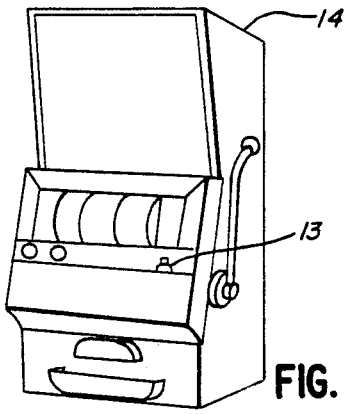
FIG. 1 is a perspective view of a gaming machine including a self teaching coin detector unit.

FIG. 1 of the drawings illustrates a slot machine 14 including a coin or token acceptance slot 13 which is representative of the type of coin operated machine that can employ the coin detector apparatus of the invention.

Figure 2:
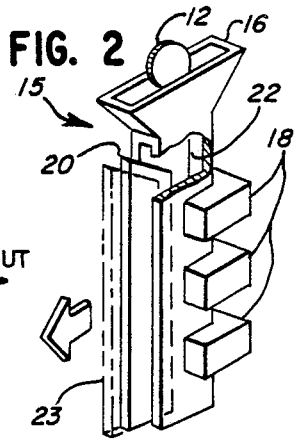
FIG. 2 is a perspective view of the mechanical portion of the coin detector unit.

In the perspective view of the preferred embodiment of a coin detector unit 15 shown in FIG. 2, a chute 16, which is in communication with the coin acceptance slot 13 of FIG. 1, receives a coin or token 12. The coin 12 then travels under the influence of gravity through a plurality of sensors, indicated at 18, via a conduit 22. The conduit includes a side 20 which can be adjusted as indicated by the dashed lines 23 utilizing fastening devices (not shown) with respect to the sensors 18 in order to accommodate coins having different diameters. Adjustment is achieved by sliding the conduit wall 20 toward or away from the sensors 18. This feature is made possible by the fact that the sensors 18 are configured so as to encompass only three sides of the conduit 22, thereby permitting the fourth side 20 free to slide in or out without interfering with the sensors 18. This feature provides a rapid and convenient method for accommodating coins or tokens having varying diameters.

Figure 3:
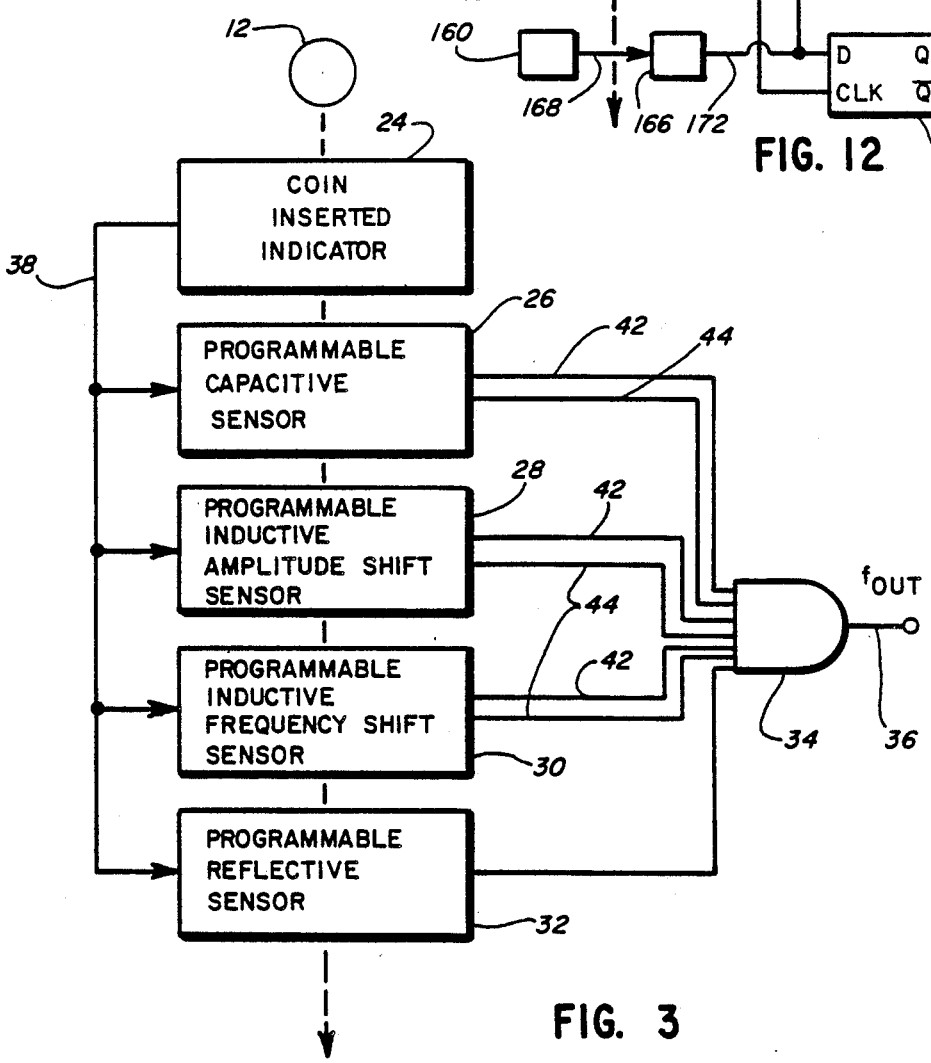
FIG. 3 is a block diagram of a coin discriminator circuit for use with the coin detector unit of FIG. 2.

As shown in FIG. 3, the preferred embodiment of the detector 15 employs four programmable sensors 26, 28 30, and 32, along with a coin-inserted indicator 24. As the coin 12 travels through the conduit 22, it passes in close proximity to each of the programmable sensors 26, 28, 30, and 32. Each of these sensors 26, 28, 30 and 32 measures a different inherent characteristic of the coin, such as size, and compares that measurement to a predetermined range defined by an upper limit and a lower limit. This range may be easily modified by adjusting these upper and lower limits, hence the term "programmable sensor." If the measurement falls within the predefined range, the programmable sensor 26, 28, 30 or 32 generates an accept signal. Otherwise, the programmable sensor generates a reject signal. All of the outputs of the programmable sensors 26, 28, 30 and 32 are connected to an AND gate 34. The output of the AND gate 34 is determinative as to whether the coin 12 will be accepted or rejected by the coin detector unit 15. Unless all of the sensor outputs are accept signals, AND gate 34 will generate a reject signal on an output line 36. Thus, a coin 12 must generate accept signals for each sensor 26, 28, 30 and 32 in order to be accepted by the detector unit 15.

The coin-inserted indicator 24 is not connected to the AND gate 34. When the coin 12 passes through the vertical conduit 22, the coin-inserted indicator 24 generates an electric pulse on an output line 38, which is connected to the programmable sensors 26, 28, 30, and 32. This pulse serves to reset the sensors so that data from a previously inserted coin 12 is not applied to the AND gate 34.

As shown in FIG. 3, the sensors 26, 28, 30 and 34 respectively include: a programmable capacitive sensor 26, which measures the coin's 12 size; a programmable inductive amplitude-shift sensor 28, which generates a signal in response to the coin's 12 magnetic properties; a programmable inductive frequency-shift sensor 30, which also generates a signal in response to the coin's 12 magnetic properties; and a programmable reflective sensor 32, which measures the coin's 12 light reflectivity.

Figure 4:
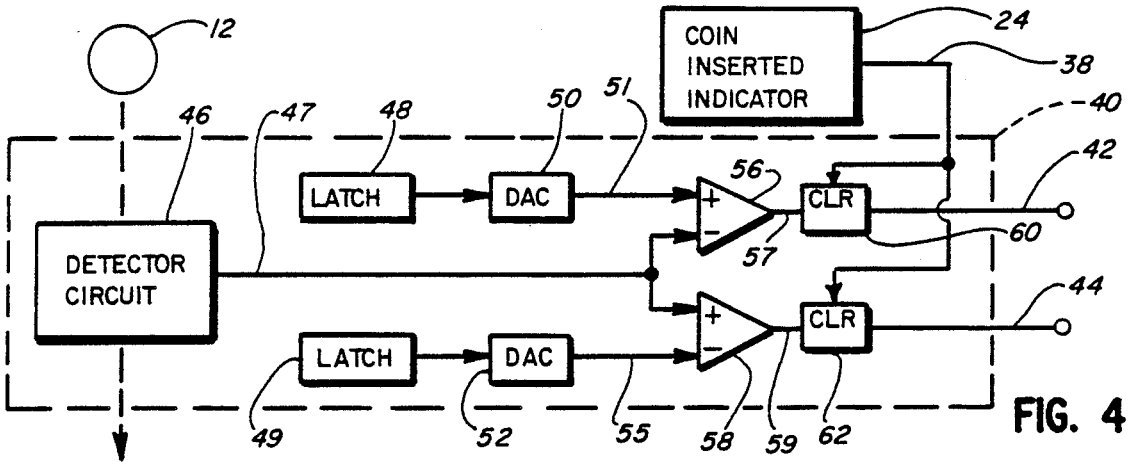
FIG. 4 is a block diagram of a programmable sensor circuit of the type used in the discriminator circuit of FIG. 3.

All of these programmable sensors 26, 28, 30, and 32 share the same basic design, which is represented in the block diagram of FIG. 4 as a generic programmable sensor 40. The programmable sensors 26, 28, 30 and 32 are primarily distinguished from one another by the operation of a detector circuit 46. In each case the detector circuit 46 includes an electronic circuit which outputs a voltage characteristic of an inherent property of the coin 12 when it passes in close proximity to the detector circuit 46.

The purpose of the programmable sensor 40 is to determine if a particular property of the coin 12 as measured by the output of the detector circuit 46 falls within a predetermined range. Coins 12 which fall within that range are accepted, and coins that do not fall within that range are rejected. This determination is accomplished by a pair of reference voltages generated on a pair of lines 51 and 55 and which are applied to a pair of analog comparators 56 and 58.

A digital latch 48 operating through a digital-to-analog convertor 50 outputs an upper reference voltage to the line 51 which is connected to a positive input of the first analog comparator 56. Similarly a second digital latch 49 connected to a second digital to analog convertor 52 outputs a lower reference voltage to the line 55 that in turn is connected to the negative input of the second analog comparator 58. The output of the detector circuit 46 on a line 47 is connected to the negative input of the first analog comparator 56 and the positive input of the second analog comparator 58.

Both analog comparators 56 and 58 will generate a reject signal (binary 0) on lines 57 and 59 respectively if the voltage on the negative input terminal is greater than the voltage on the positive input terminal, and will generate an accept signal if the voltage on the positive input terminal is greater than the voltage on the negative input terminal. Thus, the first comparator 56, will output an accept signal on line 57 only if the output voltage of the detector circuit 46 on line 47 is less than the upper reference voltage on line 51, and the second comparator 58 will output an accept signal on line 59 only if the detector circuit 46 output on line 47 is greater than the lower reference voltage on line 55. The presence of a reject signal on either the first or second comparator output lines 57 or 59 indicates that the detector circuit output voltage 47 did not fall within the range defined by the upper reference voltage on line 51 and lower reference voltage on line 55.

The programmable sensor 40 is termed "programmable" because its upper and lower reference voltages on lines 51 and 55 respectively can be easily adjusted. The ability to adjust these voltages is in effect the ability to set the range of detector circuit 46 voltage output on line 47 which will cause the analog comparators 56 and 58 to generate accept or reject signals. Since the detector circuit 46 voltage output on line 47 is a function of a particular physical property of the coin 12, the ability to determine the aforementioned range is ultimately the ability to determine the parameters of a particular physical characteristic of the coin 12 that will cause the analog comparators 56 and 58 to output an accept signal. Thus, by setting the reference voltages on lines 51 and 55, the user can program the sensor 40 to accept only those coins having characteristics, as measured by the detector circuit 46, that fall within the desired range. By changing the reference voltages on lines 51 and 55 and hence the range, the user can program the sensor 40 to accept different types of coins and tokens.

The programming of the upper reference voltage on line 51 is accomplished by placing a binary number in the first digital latch 48, which in the preferred embodiment accommodates an eight bit number, the value of which falls between 0 and 255. The first digital latch 48 is connected to the first analog-to-digital convertor 50, the output of which is the upper reference voltage on line 51. Thus, the upper reference voltage on line 51 is a direct function of the binary number stored in the first digital latch 48.

The programming of the lower reference voltage on line 55 is accomplished in the manner as described above, where the lower reference voltage on line 55 is generated by the second digital-to-analog convertor 52, which is controlled by the second eight-bit digital latch 49.

The output of the detector circuit on line 47 will vary with time as the coin 12 travels past it through the conduit 22. Consequently, the output signals on lines 57 and 59 of the first and second comparators 56 and 58 will tend to change as the detector circuit output voltage on line 47 varies with the passage of the coin 12 through the detector circuit 46. Thus, the comparators 56 and 58 may only output an accept signal for a short period of time. This period may be too short for the proper functioning of the coin detector unit 15. To ensure that the programmable sensor 40 will output an accept signal for a sufficient duration, a first and a second digital flip flop 60 and 62 are connected by lines 57 and 59 to the output of the first and second comparators 56 and 58 respectively. Specifically, the comparator outputs on lines 57 and 59 are connected to the clock inputs of the respective flip flops 60 or 62. In their initial state, the flip flops 60 and 62 output a reject signal (binary 0) onto a pair of lines 42 and 44. However, if a comparator 56 or 58 output goes high (an accept signal) it will pulse the clock input of its respective flip flop 60 or 62, thereby causing the flip flop 60 or 62 to indefinitely output an accept signal (binary 1) on line 42 or 44. Thus, if a passing coin causes the comparators to output an accept signal, that signal will effectively be latched by the first and second flip flops 60 and 62.

A clear input on the flip flops 60 and 62 is connected to the coin-inserted indicator 24 by means of the line 38. The coin-inserted indicator 38 generates a pulse on line 38 if a coin 12 is inserted into the coin detector unit 15. This pulse causes the flip flops 60 and 62 to be reset to output a reject signal (binary 0), thereby clearing any accept signals on lines 42 and 44 which may have been generated by an earlier coin.

To recapitulate, the programmable sensor 40 can be programmed to accept or reject coins having predetermined inherent characteristics by placing the appropriate binary numbers in the first and second digital latches 48 and 52. While the programming of the sensor 40 can be accomplished by a variety of methods, including the direct placement of values in the latches 48 and 50, the preferred embodiment of the invention utilizes a self teaching method which will be described in connection with FIGS. 5 and 6.

Figure 5:
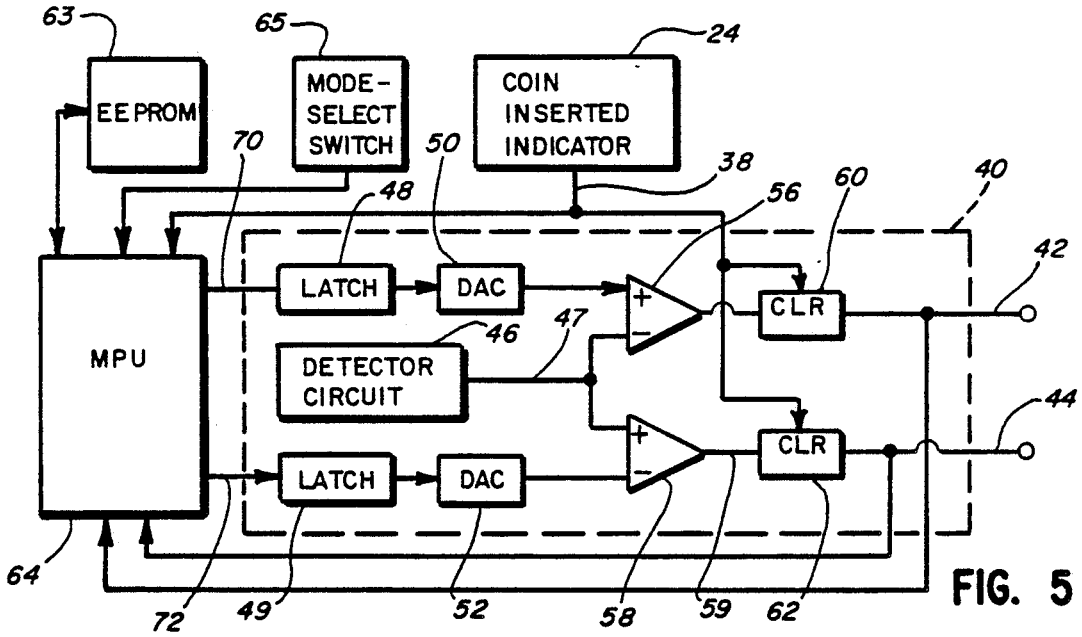
FIG. 5 is a block diagram of a system used to program the programmable sensor circuit of FIG. 4.

The self teaching approach utilizes as shown in FIG. 5 a microprocessor 64, an EEPROM memory 63, a mode select switch 65 and the coin-inserted indicator 24 in combination with the programmable sensor 40. The microprocessor 64 receives data input from: the EEPROM 63, the mode select switch 65, the coin-inserted indicator 24, the first flip-flop 60, and the second flip-flop 62. The microprocessor 64 writes data to the first and second digital latches 48 and 49 via a pair of lines 70 and 72.

Figure 6:
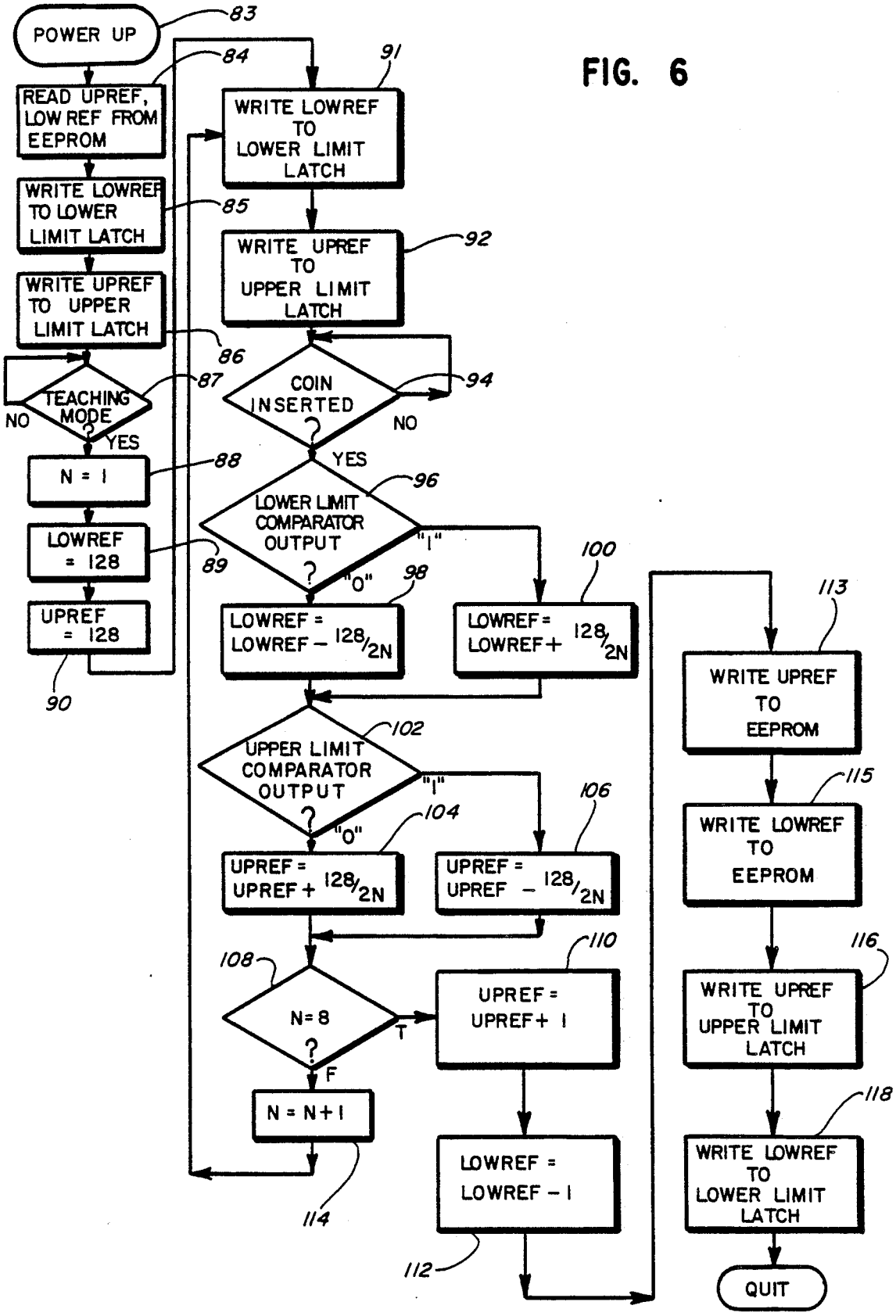
FIG. 6 is a flow chart illustrating the operation of the programming system in FIG. 5.

The microprocessor 64 operates in the self teaching mode according to the logic shown in the flow chart of FIG. 6. When power is first applied to the system at 83, the microprocessor 64 reads the EEPROM 63, as indicated in step 84. The EEPROM contains initial values for upper and lower reference voltages. These initial values can for example be set at the factory to represent known values for a standard coin. The microprocessor 64 then writes the initial values to the first and second digital latches 48 and 49, as indicated in steps 85 and 86. Upon completion of step 86, the programmable sensor 40 can operate independently from the microprocessor 64, discriminating between real and unauthorized coins as described above. This mode of operation is termed the "discrimination mode."

Alternatively, if the user wishes to have the microprocessor 64 program reference voltages for a new type of coin or token, he may select the "self-teaching mode." The selection of this mode is accomplished by means of the mode select switch 65. Once the microprocessor 64 has performed step 86, it continuously monitors the status of the mode selection switch 65, as indicated by a decision block 87. As long as the mode selection switch 65 is in the position corresponding to the discrimination mode, the microprocessor 64 periodically checks the status of the switch 65 as indicated at decision block 87 but performs no further function with respect to coin discriminator. However, if the user switches the mode select switch 65 to the position corresponding to the self-teaching mode, then the microprocessor 64 will perform the self-teaching procedure commencing with step 88.

The self-teaching procedure begins with the initialization of a coin counter variable, N, as indicated at step 88. Variables LOWREF and UPREF are also initialized at 128, as indicated by steps 89 and 90. LOWREF represents the digital value of the lower reference voltage and UPREF represents the value of the upper reference voltage. At this point, the microprocessor 64 is ready to begin accepting the eight sample coins 12. With each coin 12, the microprocessor 64 iteratively performs logic steps 91 through 114. Initially, the microprocessor 64 writes the value UPREF to the first digital latch 48 and the value at LOWREF to the second digital latch 49, as indicated in steps 91 and 92. Then, the microprocessor 64 waits as indicated by a decision block 94 for the user to insert a coin 12. When a coin 12 is inserted, the output on line 38 of the coin-inserted indicator 24 goes high. This resets the first and second flip flops 60 and 62 and allows the microprocessor to exit step 94. As the coin 12 travels past the programmable sensors 40, the sensors 40 generate either accept or reject signals on their comparator outputs 42 and 44. The microprocessor 64 first examines the output of the second (lower limit) comparator 58, as indicated at 96, which has been temporarily stored in the second digital flip flop 62. If the second comparator 58 outputs a zero (reject signal), then the detector circuit output 47 is at a lower voltage than the lower limit reference voltage on line 55. In this case, the microprocessor 64 at a step 98 decreases the LOWREF voltage by an amount equal to $128/2^N$, where N is the number of the most recent sample coin. For example, if only one sample coin had been inserted, N would equal one, and the LOWREF would be decreased by the value $128/2^1$, or 64. If the second comparator outputs a one (accept signal), then the microprocessor 64 at step 100 increases the LOWREF voltage by an amount equal to $128/2^N$.

This process is repeated as indicated at steps 102 through 106 for the first (upper limit) comparator 56. In this case, a zero (reject signal) on the comparator 56 output line 57 means that the detector output 47 exceeds the upper limit reference voltage on line 51. Consequently, the microprocessor will increase the UPREF by an amount equal to $128/2^N$ as indicated at 104. Likewise, a one (accept signal) would cause the microprocessor 64 to decrease UPREF by an amount equal to $128/2^N$, as indicated at step 100.

After completing the first iteration as described above, the microprocessor 64 examines the coin counting variable, N, as indicated at a decision block 108. If N does not equal 8, then the microprocessor 64 increments N by 1, as indicated at 114, writes the new value of UPREF to the first digital latch 48, as indicated at 92, writes the new value of LOWREF to the second digital latch 49, as indicated at 91, and awaits the insertion of the next sample coin, as indicated at 94. When the next coin 12 is inserted, the above described process is repeated.

As these iterations continue, the upper and lower reference values converge on the limits of the range of detector 46 output voltages induced by the eight sample coins, so that upon completion of this procedure, the upper and lower reference voltages on lines 51 and 55 will define an acceptance range for coins of the same type as the eight sample coins.

As indicated at 114, after each coin 12 has been inserted the microprocessor 64 increments the coin-counting variable, N. After eight coins have been inserted, N will be equal to 8 resulting in the microprocessor 64 terminating the iterative process, as indicated at decision block 108. The microprocessor 64 will then increment the UPREF by one, as indicated at 110, and decrements the LOWREF by one, as indicated at 115 in order to provide for a small margin of error in the acceptance range. The final values of UPREF and LOWREF are written to the EEPROM 63, as indicated in steps 113 and 115. Lastly, the microprocessor 64 will write UPREF to the first digital latch 48 and LOWREF to the second digital latch 49, as indicated by steps 116 and 118.

Figure 7:
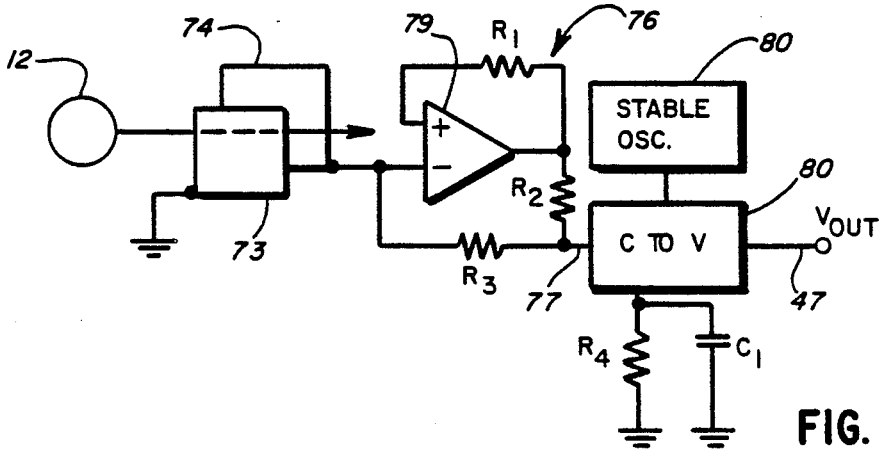
FIG. 7 is a schematic diagram of a capacitive detector circuit that can be used as one of the detector circuits in the programmable sensor circuit of FIG. 4.

The preferred embodiment of a detector circuit 46 utilizing a capacitive approach for use with the programmable sensor 26 is shown in FIG. 7. The capacitive detector circuit of FIG. 7 measures the coin's 12 diameter and thickness by measuring the change in capacitance between a pair of opposed metal plates 73 and 74 induced by the passage of the coin 12 between the plates 74 and 73. Specifically, the two plates are positioned along opposite sides of the vertical rectangular conduit 22 through which the coin 12 travels. One plate 73 is electrically grounded and the other plate 74 is operatively connected to a capacitive multiplier indicated generally at 76. As the coin 12 moves between the plates 73 and 74, it acts as a dielectric. The dielectric characteristics of the coin 12 are a function of the coin's 12 thickness and diameter as well as to some extent the particular metallic alloy of the coin 12. The resulting increase in the capacitance between the two plates 73 and 74 caused by the passage of the coin 12 is amplified by the capacitive multiplier circuit 76. The amplified measure of capacitance on line 77 is converted to voltage by a capacitance to voltage convertor 80. The output of the C-to-V convertor 80 is suitable for comparison with predetermined reference voltages on lines 51 and 55, as shown in FIG. 4.

Specifically, the capacitive multiplier 76 includes an operational amplifier 79, the negative input of which is connected to the metal plate 74 which is not grounded. A resistor R1 connects the output of the amplifier 79 with its positive input. Two resistors, R2 and R3, connected in series, connect the output of the amplifier 79 with its negative input. The C-to-V convertor 80 is preferably a digital tachometer 80. The tachometer 80 is connected to the capacitive multiplier 76 at the node between resistors R2 and R3 by line 77.

A second embodiment of detector circuit 46 is shown in FIG. 8, which depicts the preferred embodiment of an inductive amplitude-shift detector circuit ("amplitude detector") for use with the programmable sensor 28. The amplitude detector of FIG. 8 consists of a conventional oscillator circuit, shown generally within the dashed lines 120, a buffer 126, and a conventional peak detector circuit 128. The oscillator 120 normally generates a sinusodial signal of constant amplitude and frequency. As is conventional, the peak detector 128 outputs a voltage proportional to the amplitude of that signal received via buffer 126. The oscillator 120 includes a pair of inductive coils 122 and 124 connected in series. Each coil 122 and 124 is wrapped around one of two U-shaped ferrite cores 190 and 192, in the manner shown in FIG. 13. The cores 190 and 192 are positioned on opposite sides of the vertical rectangular conduit 22 through which the coin 12 passes. As the coin 12 passes in close proximity to the coils 122 and 124, it affects the inductive relationship of the coils, thereby varying the amplitude of the oscillator 120. The effect of the coin 12 on the amplitude of the oscillator 120 signal is primarily a function of the coin's 12 inherent magnetic properties, although the coin's 12 size also has some effect. The change in amplitude causes a change in the voltage output of the peak detector 128. Thus, the voltage output of the peak detector 128 on line 47 is reflective of the inherent magnetic properties of the coin 12, and is suitable for comparison with reference voltages on lines 51 and 55.

A significant feature of the above mentioned coils 122 and 124, and their respective cores 190 and 192, is that they are designed to accommodate coins 12 of varying sizes. This accommodation is achieved by placing the two cores 190 and 192 so that they do not encompass the entire coin path 22. The cores may be moved closer together or farther apart depending on the size of coin 12. In addition, because the coils 122 and 124 are wired in series by line 125, the coin's 12 relative distance between the cores 190 and 192 will not significantly affect the change in inductance of the coils 122 and 124 caused by the passage of the coin 12 between the cores 190 and 192.

A third embodiment of the detector circuit 46 is shown in FIG. 10, which depicts the preferred embodiment of the inductive frequency-shift detector circuit ("frequency detector") for use with the programmable sensor 30. The frequency detector of FIG. 10 consist of an oscillator 136, a frequency divider 138, and a frequency-to-voltage convertor 140. The oscillator 136 is identical to the oscillator 120 depicted in FIG. 8 and as such it normally generates a sinusodial output signal on a line 139 of constant frequency and amplitude. The frequency divider 138 reduces the frequency of the signal on line 139 by a factor of 2 and outputs to the convertor 140 on a line 141 a square wave signal having a 50% duty cycle and a constant amplitude. In response to the signal on line 141 the frequency-to-voltage convertor 140 generates a constant output voltage on the line 47 which is proportional to the frequency of the oscillator signal on line 139.

When the coin 12 passes in close proximity to the inductive elements 122 and 124 of the oscillator 136, it causes a change in the frequency of the oscillator 136 output. The propensity of the coin 12 to affect the frequency of the oscillator signal is primarily a function of the coin's inherent magnetic properties (the coin's 12 size also has some effect). This change in frequency causes a change in the output voltage on the line 47 of the frequency-to-voltage convertor 140. Consequently, the output voltage on line 47 of the convertor 140 is a function of the coin's 12 inherent magnetic properties.

Figure 11:
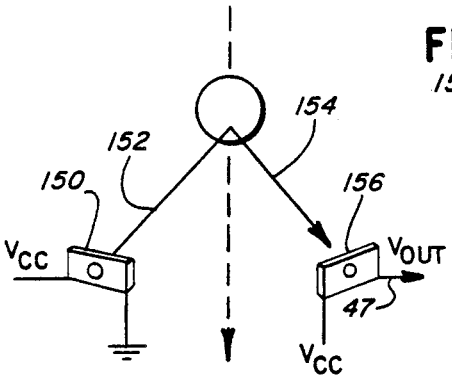
FIG. 11 is a schematic diagram of a reflectivity detector circuit that can be used in the programmable sensor circuit of FIG. 4.

A fourth embodiment of the detector circuit 46 is shown in FIG. 11 which depicts the preferred embodiment of the reflective detector circuit ("reflective detector") for use with the programmable sensor 32. The reflective detector of FIG. 11 includes a light emitting element 150 and a light sensing element 156. The light emitting element 150 projects a light beam of infrared or visable light indicated by a line 152 which impinges upon a passing coin 12 and is reflected off the coin 12, as indicated by a line 154. The reflected light beam 154 strikes the light sensing element 156, which generates a voltage on the line 47 proportional to the intensity of the reflected light 154. As with the other detector circuits, the voltages on line 47 can be compared to the reference voltages on lines 51 and 55.

Figure 12:
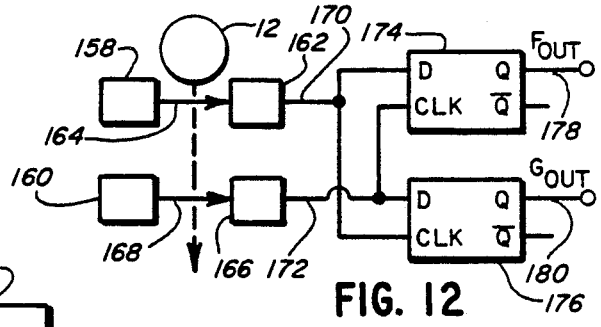
FIG. 12 is a schematic diagram of a sensing circuit which can detect when a coin is traveling through the coin discriminating apparatus in the wrong direction.

A separate aspect of the invention is an anti-stringing detector, illustrated in FIG. 12. While the anti-stringing detector is not directly related to the programmable sensor circuits 26-32, it is also positioned along the vertical conduit 22, illustrated in FIG. 2. Its purpose is to discourage machine users from performing what is known as "stringing". This scheme involves affixing a string or cord to a coin so that the coin may be retrieved after it has been inserted into the coin operated machine 14.

As shown in FIG. 12, the anti-stringing device is a circuit to detect the direction in which a coin 12 is traveling through the vertical conduit 22. It includes a pair of light emitting elements 158 and 160 and a pair of light sensing elements 162 and 166. The light emitting elements 162 and 166 each project a beam of light, indicated by lines 164 and 168. Preferably beams of light 164 and 168 are separated by approximately ⅛ of an inch in the vertical direction and they cross the conduit 22 through which coin 12 travels. As shown in FIG. 12 the light beam 164 is directed to light sensing element 162, and the light beam 168 is directed to light sensing element 166.

Absent any interruption in light beams 164 and 168, the light sensing elements 162 and 166 will not output signals. However, if light beam 164 is broken, then light sensing element 162 will output a pulse onto line 170 which is connected to the D input of a first flip flop 174, and a clock input of a second flip flop 176. Similarly, if the light beam 168 is broken, then light sensing element 166 will output a pulse onto a line 172 that is connected to the D input of the second flip flop 176 and the clock input of the first flip flop 174.

Because the outputs of the light sensing elements 162 and 166 are cross-connected to the flip flops 174 and 176, the sequence in which the light beams 164 and 168 are broken will determine the outputs of the flip flops 174 and 176. Since this sequence is a function of the direction in which coin 12 is traveling, the output of the flip flops 174 and 176 becomes an indicator of that direction.

To illustrate this operation, assume that the coin 12 is traveling in a downward direction as indicated in FIG. 12. As the coin 12 breaks light beam 164, it causes first light sensing element 162 to generate a voltage on output line 170 which is applied to the clock input of the second flip flop 176. The input of the second flip flop 176 is connected via line 172 to the second light sensing element 166. Since the coin 12 has not yet reached light beam 168, the second light sensing element 166 will not output a signal. Thus, when the second flip flop 176 is clocked, it will place a null signal onto output line 180.

As the coin 12 continues traveling downward, it breaks the second light beam 168. This causes the second light sensing element to generate a voltage on its output line 172 which is applied to the clock input of the first flip flop 174. Since, the light beams 164 and 168 are in close proximity, the coin 12 will still be blocking the first beam 164 as it breaks the second beam 168. Consequently, the first light sensing element 162 will still be generating a voltage on output line 170, which is connected to the input of the first flip flop 174. Thus, when the first flip flop 174 is clocked, it will place a positive voltage onto its output line 178. After the coin has passed both light beams 164 and 168, line 178 will remain high, and line 180 will remain null.

If the coin 12 were to travel in the upward direction, the same process would occur in reverse. This would have the effect of setting line 180 high and line 178 null. Consequently, examination of output lines 178 and 180, by, for example, the microprocessor 64, will indicate in which direction the coin 12 has traveled.

From the above descriptions it should be apparent that the disclosed coin discriminator provides a number of very significant advantages over prior systems. For example, the combination of sensor circuits which measure the size of and magnetic properties of the coin 12 along with the coin's light reflectivity provide for a particularly thorough examination of the coin. Then, by utilizing a logic circuit directly connected to the sensors to generate accept or reject signals, the efficiency of the system is enhanced since it is no longer necessary to have a microprocessor examine the output of the sensors individually. The flexibility of the coin discriminator is increased substantially by making the sensors programmable and this flexibility is increased even more by the particularly a convenient self-teaching mode as described above. The unique anti-stringing circuit used in combination with the sensors provides a further enhancement to the security of operation of the machine.

As a result, this coin discriminator provides a system that is unmatched in terms of accuracy and flexibility.

I claim:

1. A programmable coin sensor apparatus comprising:

detector means for generating an analog detector signal representative of an inherent characteristic of a coin;

first storage means for storing a digital upper limit signal;

second storage means for storing a digital lower limit signal;

first digital to analog means operatively connected to said first storage means for converting said digital upper limit signal to an analog upper limit signal;

second digital to analog means operatively connected to said second storage means for converting said digital lower limit signal to an analog lower limit signal;

comparator means operatively connected to said detector means, and said first and second digital to analog means for generating an accept signal if said analog detector signal is between said upper analog limit signal and said lower analog limit signal.

2. A programmable coin sensor apparatus comprising:

a detector circuit for generating a voltage output which is directly related to an inherent characteristic of a coin passing in close proximity to said detector circuit;

a first digital storage element containing a binary number corresponding to a predetermined highest voltage output from said detector circuit;

a second digital storage element containing a binary number corresponding to a predetermined lowest voltage output from the detector circuit;

a first digital-to-analog convertor operatively connected to said first digital storage element, for generating a first analog voltage which is directly dependent on the value of the binary number in said first digital storage element;

a second digital-to-analog convertor operatively connected to said second digital storage, for generating a second analog voltage which is directly dependent on the value of the binary number in said second digital storage element a first analog comparator operatively connected to the output of the said first digital-to-analog convertor and said detector circuit for generating a first accept signal when said voltage output of said first analog voltage equals or exceeds said voltage output of said detector circuit;

a second analog comparator operatively connected to the output of the said second digital-to-analog convertor and said detector circuit for generating a second accept signal when said voltage output of said detector circuit is less than said voltage output of said second digital-to-analog convertor;

reset means for generating a reset signal;

a third digital storage element operatively connected to both said reset means and said first analog comparator for normally outputting a first reject signal until receiving from said first comparator said first accept signal, at which time said third digital storage element outputs a third accept signal, and continues to output said third accept signal until it receives said reset signal from said reset means, at which time it outputs said first reject signal; and a fourth digital storage element which is operatively connected to both said reset means and said second analog comparator for normally outputting a second reject signal, until receiving from said second comparator said second accept signal, at which time said fourth digital storage element outputs a fourth accept signal, and continues to output said fourth accept signal until it receives said reset signal from said reset means, at which time it outputs said second reject signal.

3. An apparatus of claim 2 wherein said first and second digital storage elements are eight-bit data latches.

4. An apparatus of claim 2 wherein said third and fourth digital storage are flip flops having clock inputs connected to said first and second analog comparators, and having clear inputs connected to said reset means.

5. The apparatus of claim 2 wherein the detector circuit includes means for measuring the magnetic characteristics of said coin.

6. The apparatus of claim 2 wherein the detector circuit includes means for measuring the size of said coin.

7. A coin directional sensor apparatus for determining whether a coin is moving in an improper direction, comprising:

guiding means for guiding a coin along a predetermined path of transport;

first and second photosensor means disposed along said path of transport, said photosensor means responsive to the passage of any opaque object, and said photosensor means being placed in close proximity to each other so that an object traveling down the coin path in a particular direction will trigger said first and second sensors in a particular sequence, and a coin traveling in the opposite direction will trigger the sensors in the opposite sequence; and logic means operatively connected to said first and second photosensor means, said logic means being responsive to sequence in which said first and second photosensor means are triggered by the passage of an object through said path of transport, said logic means comprising a first digital flip-flop, said first flip-flop having a clock input connected to said second photosensor means, and said first flip-flop having a data input connected to the output of said first photosensor means, and a second digital flip-flop, said second flip-flop having a clock input connected to the output of said first photosensor means and having a data input connected to the output of said second photosensor means.

8. A detector circuit apparatus for measuring the magnetic properties of a coin, comprising:

an oscillating circuit;

guiding means for guiding the coin through a portion of said oscillating circuit; and detecting means responsive to the changes in the characteristics of the output signal of said oscillator, said output signal being representative of the magnetic characteristics of said coin, and said detecting means including means for detecting a change in the amplitude of the output signal of said oscillator circuit, and means for detecting a change in the frequency of the output signal of said oscillator circuit, said frequency detecting means further comprising;

a frequency divider means operatively connected to said oscillating circuit; and a frequency to voltage converter operatively connected to said frequency divider whereby a change in the frequency in the output of said oscillating circuit will cause the output voltage of said frequency to voltage converter to vary, said frequency divider means further including a DQ flip-flop chip, the clock input of which is connected to the output of said oscillating circuit so as to cause said flip-flip to output a high digital signal at a frequency equal to one-half the frequency of the output signal of said oscillating circuit means.

9. A programmable coin discriminator apparatus comprising:

a coin guide;

a plurality of programmable sensors operatively associated with said coin guide wherein each of said programmable sensors include a detector circuit for generating an identification signal representing inherent characteristics of a coin traversing said coin guide;

memory elements for storing upper and lower limit values for said identification signal; a comparator circuit operatively connected to said memory elements and said detector circuit; and programming means operatively connected to said comparator circuits and to said memory elements for independently entering said upper and lower limit values in said memory elements in response to signals from said comparator circuits for a plurality of coins traversing said coin guide, said memory elements further including;

first and second digital storage means for storing in digital form said upper and lower limits, respectively;

first and second converter means for converting upper and lower limit values into analog voltages, said converter means operatively connected to said first and second digital storage means, respectively;

first logic means operatively connected to said first converter means and said detector circuit for generating an accept signal if the voltage output of first converter means is less than the voltage output of said detecting circuit; and second logic means operatively connected to said second converter means and said detector means, for generating an accept signal if said detector circuit output voltage exceeds said second converter means voltage.

10. The apparatus of claim 9 further including first and second flip-flops operatively connected to said first and second logic means, and operatively connected to a coin inserted sensor, said flip-flops in their normal state effective to generate a reject signal until such time as said logic means generate an accept signal, and wherein said flip-flops are reset to said normal state in response to said coin inserted sensor.

11. A detector circuit apparatus for measuring the magnetic properties of a coin, comprising:

an oscillating circuit;

guiding means for guiding the coin through a portion of said oscillating circuit; and detecting means responsive to the changes in the characteristics of the output signal of said oscillator, said output signal being representative of the magnetic characteristics of said coin, said detector means including means for detecting a change in the frequency of the output signal of said oscillator circuit including a frequency divider means operatively connected to said oscillating circuit and a frequency-to-voltage converter operatively connected to said frequency divider, whereby a change in the frequency in the output of said oscillating circuit will cause the output voltage of said frequency-to-voltage converter to vary.

* * * * *